United States Patent [19]

Hofmann

[11] Patent Number: 4,573,291

[45] Date of Patent: Mar. 4, 1986

[54] RIDGE OR HIP COVERING FOR TILED ROOFS

[75] Inventor: Karl-Heinz Hofmann, Mucke, Fed. Rep. of Germany

[73] Assignee: Braas & Co. GmbH, Frankfurt, Fed. Rep. of Germany

[21] Appl. No.: 583,184

[22] Filed: Feb. 24, 1984

[30] Foreign Application Priority Data

Feb. 26, 1983 [DE] Fed. Rep. of Germany ..... 3306837

[51] Int. Cl.[4] ..... B61D 17/14

[52] U.S. Cl. ..... 52/43; 52/90; 52/58

[58] Field of Search ..... 52/43, 57, 90, 94, 96, 52/276, 277, 278

[56] References Cited

FOREIGN PATENT DOCUMENTS

| | | | |
|---|---|---|---|
| 0056292 | 7/1982 | European Pat. Off. | 52/90 |
| 2737570 | 8/1978 | Fed. Rep. of Germany | 52/43 |
| 2075081 | 11/1981 | United Kingdom | 52/90 |

*Primary Examiner*—Carl D. Friedman
*Assistant Examiner*—Creighton Smith
*Attorney, Agent, or Firm*—Emory L. Groff, Jr.

[57] ABSTRACT

In this ridge or hip covering, flexible sealing strips (9) are arranged between the covering caps (7) fastened to the ridge or hip board (6) of the roof structure and the roofing tiles (3).

In order that the sealing strips (9) can universally be used with the most different roofing tiles and roof pitches, they comprise a flexible supporting strip (10) which is provided on one or both longitudinal edges (11) with a comblike edge part (12) of elastically deformable material, the teeth (12*a*) of which are connected with an edge strip (13) of flexible material which bridges the tooth spaces allowing the teeth to spread, whereby the outer longitudinal edge (14) of the edge strip adapts to the contour of the upper side of the roofing tiles (3) lying below it.

If with the sealing strips (9) both a sealing against rain and driving snow and a ventilation of the roof space is to be made possible, an air-permeable bonded fabric, in particular of polyester or polyamide fibres, can be used for the edge strip (13). A ventilation is also made possible if the supporting strip (10) has in its part, which is situated at the side of the ridge or hip board (6), ventilation apertures and is provided with upright supports for the covering caps (7).

14 Claims, 6 Drawing Figures

RIDGE OR HIP COVERING FOR TILED ROOFS

Figure 1:
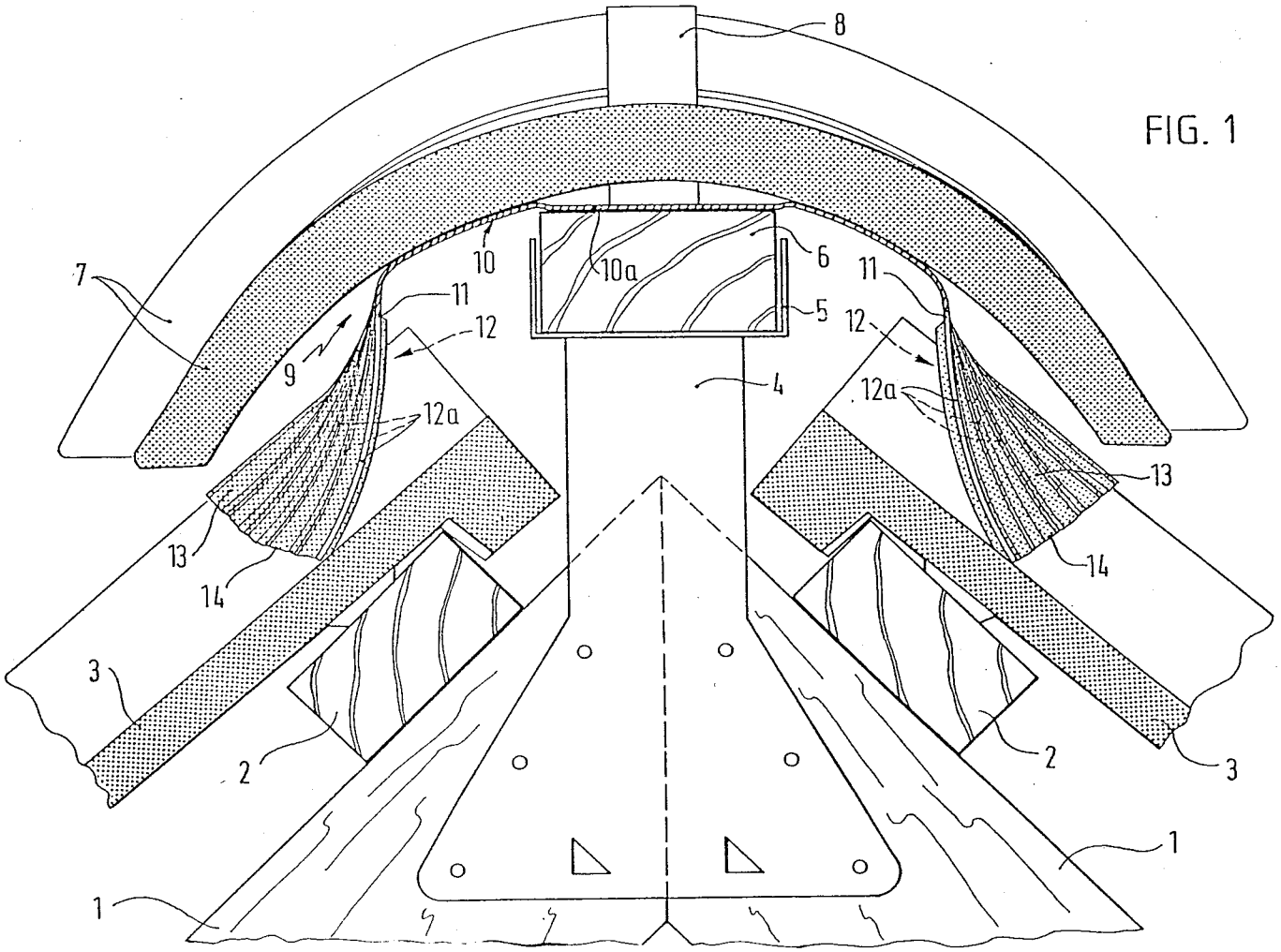

The invention relates to a ridge or hip covering for tiled roofs comprising of covering caps fastened to the ridge or hip board of the roof structure to form the uppermost covering of the ridge or hip, and of flexible sealing strips positioned between the caps and the roofing tiles and which with their longitudinal edges engaging the surface of the roofing tiles.

An example of the prior art ridge, or hip covering is shown in DE-GM 1 967 871, wherein the sealing strips arranged between the covering caps and the roofing tiles are fastened to the ridge or hip board of the roof and have a curved cross sectional shape adapted to engage the inner side of the covering caps. To provide a good seal, the two edges of these sealing strips, must have a close fit with the upper surface of the roofing tile adjacent the ridge. Because of the different shapes of roofing tiles, sealing strips have to be kept in stock. Even more of a problem is an accurate bit of the edges of these sealing strips to the upper sides of the roofing tiles when using the sealing strips as a hip sealing, because the supporting surface for the edges of the sealing strips in the area of the hips is not only dependent upon the shape of the roofing tiles but also on the roof pitch.

The object of this invention is to provide a ridge or hip covering for tilted roofs that can be universally used with different roofing tiles as well as with different roof pitches.

The problem is solved according to the invention, in that the sealing strips each comprise a flexible supporting strip which is provided on one or both longitudinal edges with a toothed comblike edge part of elastically deformable material, the teeth of which are interconnected with an edge strip of flexible material that bridges the tooth spaces thereby allowing the teeth to be spread apart so that its outer longitudinal edge adapts to the surface contour of the side of the roofing tiles.

A sealing strip of this invention adapts closely to the most different surfaces due to the spreading ability of the toothed comblike edge part of elastic material and of the edge strip of flexible material bridging the tooth spaces, whereby the sealing strip can universally be used for roofs covered with any kind of roofing tiles as well as for any type of roof pitches. The sealing strips of this invention can have the sealing edge on one side only, whereby two identical sealing strips can be attached symmetrically on the ridge board in a known manner; however sealing strips provided with a sealing edge on both sides are readily installed can be produced faster and more economically.

Indeed, as shown in No. DE-05 27 07 384 it is old in the art to use a covering strip of plastic material for a ridge covering that is fastened on a doubled roof batten at in the vertex of the ridge and the longitudinal edges of the covering have toothed members projecting outwardly in a comblike manner, whereby the teeth adapt to the surface contour of the ridge-sided roofing tiles. For this type of structure, ventilation is needed in the ridge area. However, a satisfactory sealing of the ridge area cannot be made in the case of uneven roofing tiles because of the fanlike spreading of the teeth and the open areas resulting therefrom.

In a preferred embodiment of the invention, a supporting strip is provided with a toothed comblike edge part that has uniformly spaced teeth, and an edge strip that is fastened to the teeth of the edge part in a manner that edge strip portions of the same size bridge the space between adjacent teeth.

According to another embodiment of the invention, the edge strip comprises a wavelike profiled material fastened at its wave crests to the underside of the teeth of the comblike edge part. In this manner the edge strip portions situated between the teeth extend in a pre-curved configuration towards the roofing tiles, whereby a continuous close fit between the edge strip portions and the upper side of the roofing tiles lying below them is obtained.

A connection of the edge strip with the individual teeth of the comblike edge part can be carried out in different ways. Preferably, however, the edge strip is welded or bonded to the teeth of the edge part.

If it is provided that the width of the edge strip equals the width of the toothed comblike edge part, then the edge strip is supported at its outer longitudinal edge by the teeth of the edge part and thus, in case of a strong wind, the edge strip is kept in contact with the roofing tiles lying below it.

The use of the sealing strips designed according to the invention is, in principle, possible with all known roofing tiles if the stretched length of the edge strip is in a range of 1.25 to 2.5 times the length of the toothed comblike edge part. In this connection, for contoured roofing tiles having a relatively flat undulating surface, sealing strips will suffice, in which the ratio of the stretched length of an edge strip to the length of the toothed comblike edge part is in the lower part of said range; whereas, for contoured roofing tiles having a wavy surface, it is best to chose sealing strips, in which the ratio of the stretched length of the edge strip to length of the edge part is in the upper part most roofing tiles is one in which the the greater part of the known roofing tiles is obtained if the stretched length of the edge strip is 2 times the length of the comblike edge part.

In the sealing strip according to the invention, the supporting strip, the toothed comblike edge part, and the edge strip may consist of a weather-proof and age resistant plastics material. Suitable for this purpose are sealing strips in which, for example, the supporting strip as well as the comblike edge part consist of rigid PVC and the edge strip of flexible PVC. The sealing strip sealing strip according to the invention to provide both a seal for rain and driving snow and ventilation of the roof space, then the supporting strip as well as the toothed comblike edge part is to be constructed to rigid PVC and the edge strip of an air-premeable bonded fabric, in particular of polyester or polyamide fibres. Ventilation is also made possible if the supporting ridge or hip board, ventilation apertures separated by upright supports for carrying the covering caps. Well suited for this purpose are sealing strips in which the material thickness of the supporting strip and the comblike edge part is between 0.6 to 1.5 mm, and preferably 1.00 mm, and the material thickness of the edge strip is between 0.05 to 0.5 mm, and preferably 0.15. Further, the most desirable dimensions of the toothed comblike edge parts are: length 50 to 100 mm with the preferred length being 75 mm: the width of the individual teeth as well as the distance between adjacent teeth being 3 to 5 mm with the most desirable dimension being 4 mm. These dimensions are particularly suitable for the sealing strip of this invention.

Figures 2, 3:
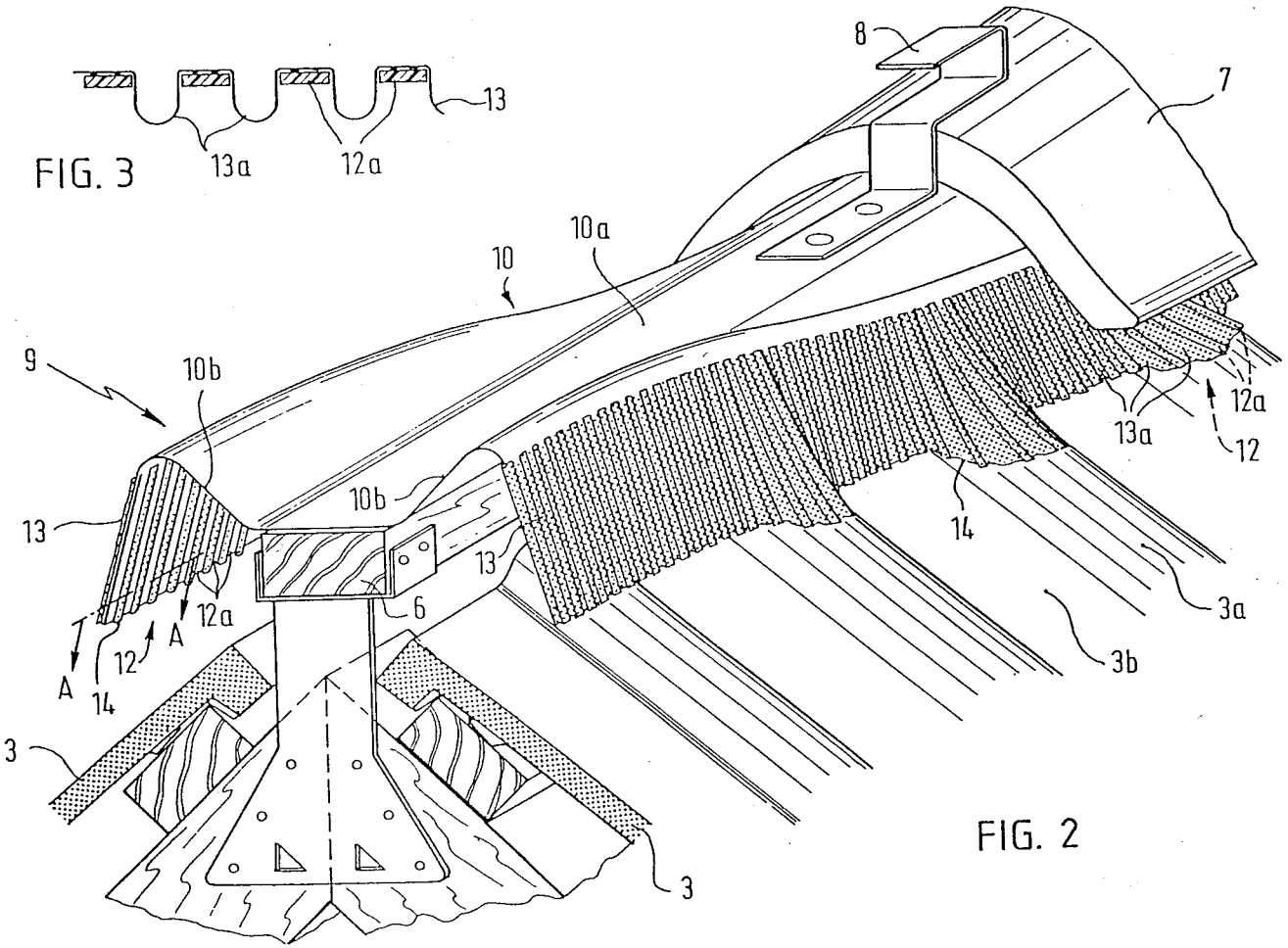
Figure 4:
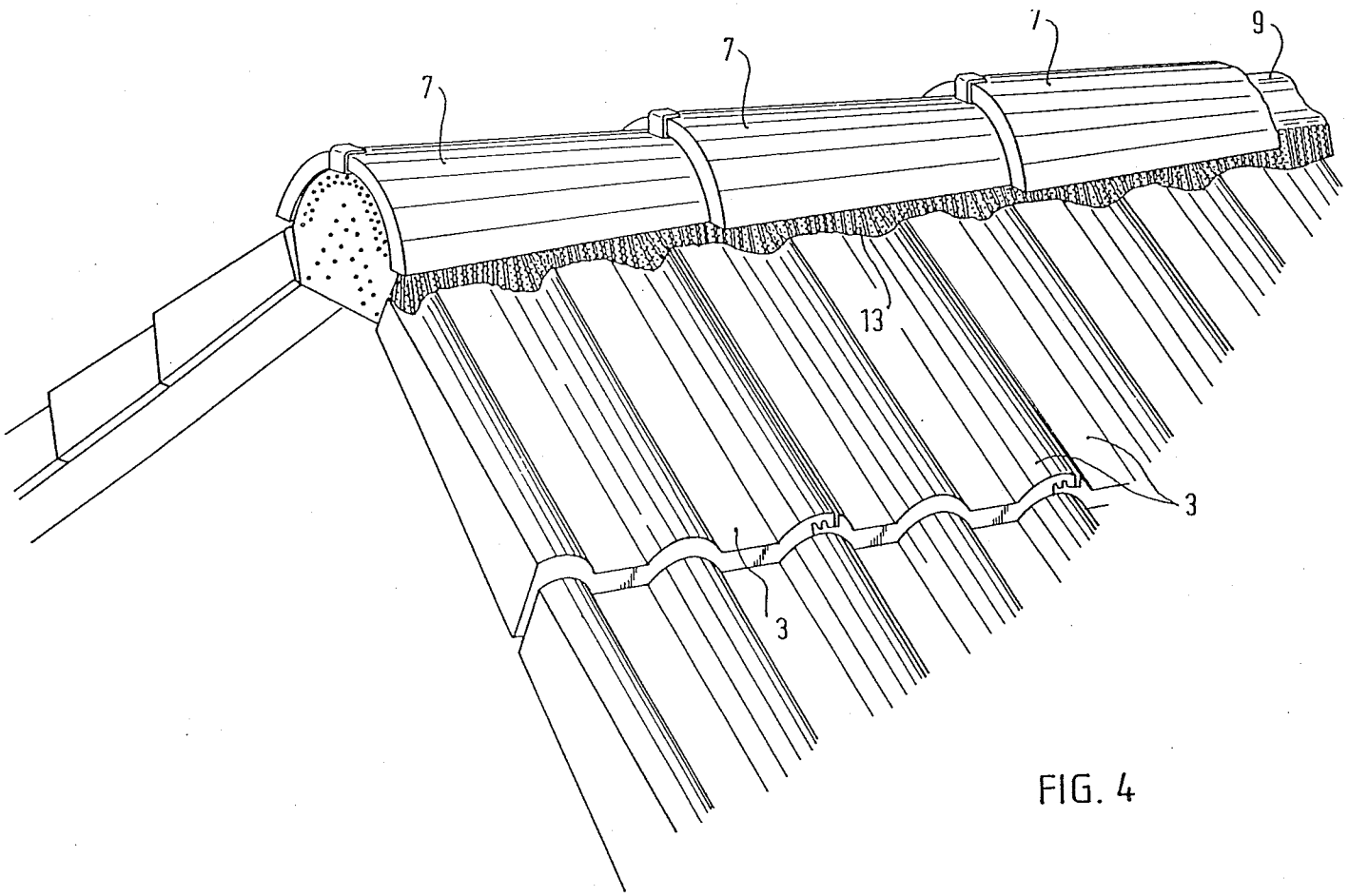
Figure 5:
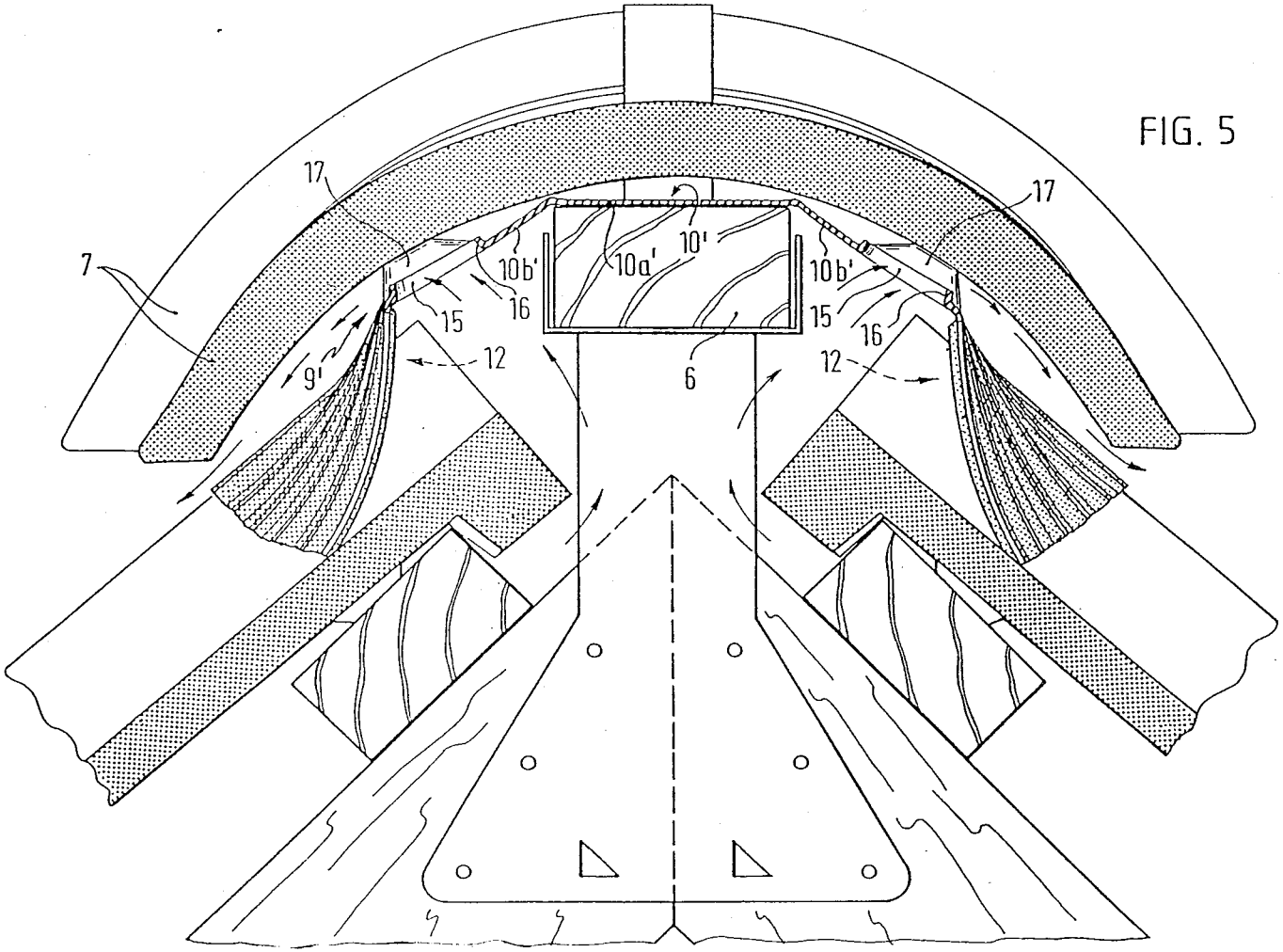
Figure 6:
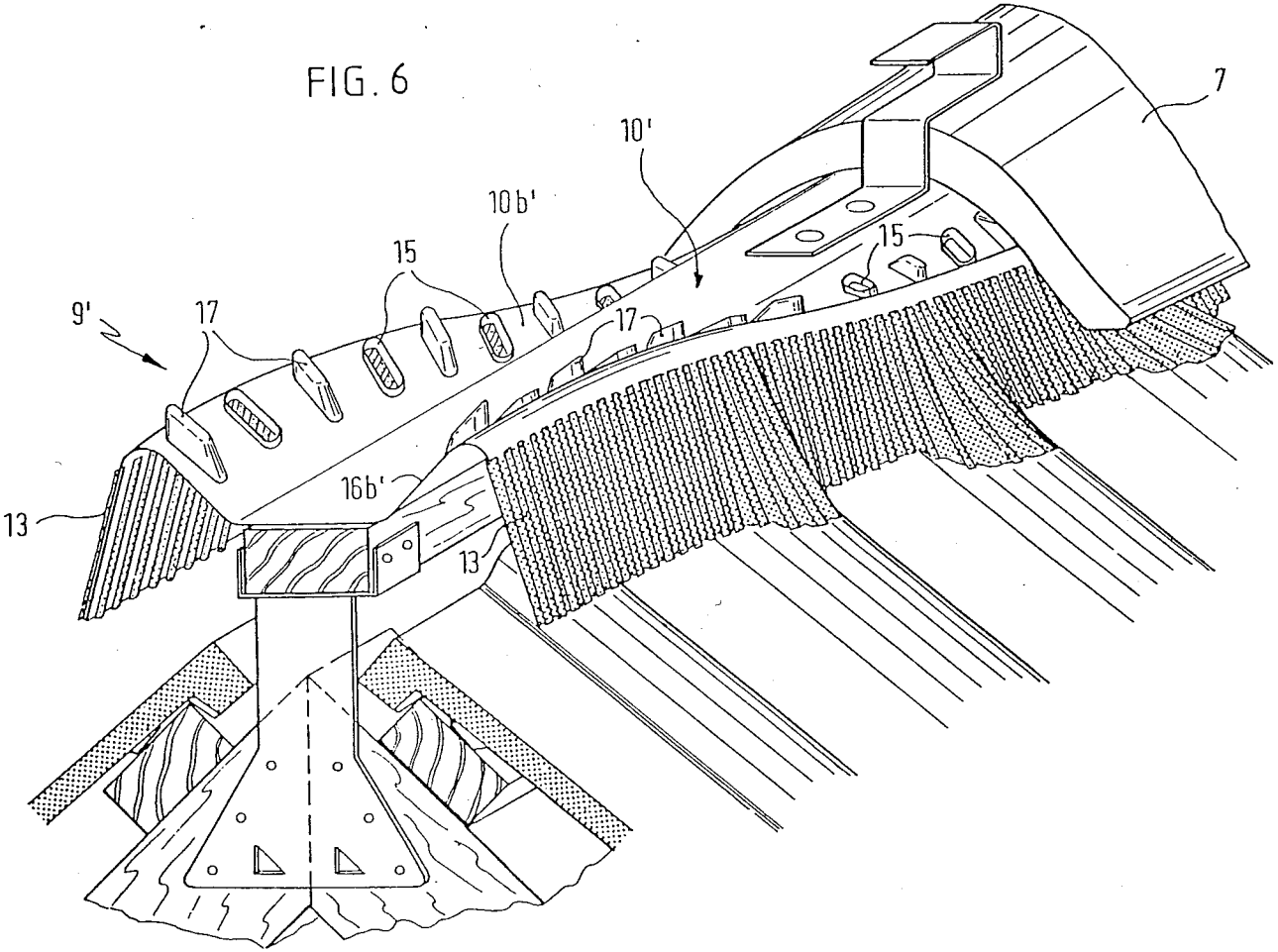

In the drawings there are shown two embodiments of the invention, in which:

FIG. 1 shows, in sectional view, a ridge covering with a sealing strip according to the invention, FIG. 2 is a perspective view of a portion of a sealing strip of FIG. 1 fastened to the ridge board of a roof and partly covered by a covering cap, FIG. 3 is an enlarged sectional view along line A—A of an edge portion of the sealing strip of FIG. 2, FIG. 4 is a perspective view of a portion of a tiled roof ridge, FIG. 5 is a sectional view similar to FIG. 1, showing another embodiment of a sealing strip and, FIG. 6 is a perspective view of the embodiment of the sealing strip of FIG. 5.

As illustrated in FIG. 1, roof battens 2 are fastened to the rafters 1, and in turn support the roofing tiles 3. Also fastened to the rafters is a ridge-board support 4 which has at its upper portion a U-shaped extension 5 for accommodating a ridge board 6. Covering caps 7 extend the length of the ridge and in each case are fastened to the ridge board 6 by means of engaging clips 8. A sealing strip 9, approximately 1.5 meters in width is positioned between the covering caps 7 and the roofing tiles 3 and comprises an elastically flexible supporting strip 10, the middle part 10*a* of which rests on the ridge board 6 and is secured thereto by clips 8. A comblike edge part 13 is integrally formed with supporting strip 10 and extends along longitudinal edges 11 of the supporting strip 10. Comblike edge part 12 includes a plurality of teeth 12*a* connected to each other by preformed flexible edge strip 13 which has an outer longitudinal edge 14 resting on the contoured surface of the roofing tiles 3. There is shown in FIG. 2 a portion of a sealing strip 9 prior to its installation. The middle part 10*a* of the supporting strip 10, rests on the ridge board 6 and is secured thereto by means of clips 8. Legs 10*b* are formed to project upwardly and will be pressed down during the covering of the roof by the covering caps 7, so that the edge strips 13 of the sealing strip 9 carrying teeth 12*a* are biased to adapt with their longitudinal edges 14 to the surface of roofing tiles 3 lying below them. At the same time, there occurs in the area of the rolls 3*a* of the roofing between the teeth; whereas, in the area of the flat parts 3*b* of the roofing tiles 3, located between the rolls 3*a*, teeth 12*a* will not be spread apart and portions 13*a* of the edge strip 13 will not be stretched.

As seen in FIG. 3 there is shown an edge portion of the sealing strip 9 of FIG. 2 prior to being pressed against the upper side of a roffing tile 3. The flexible edge strips 13 of the sealing strip consists of a wavelike material, which in profile is adapted to the spacing of the teeth 12*a* of the comblike edge parts in such a manner that edge strips 13 rest with their wave crests on the surface of teeth 12*a* and their wave troughs project downwardly between adjacent teeth 12*a* to form portions 13*a* of equal size whereby teeth 12*a* can be spread apart. Strip 13 can be fastened to teeth 12*a* by an adhesive or by welding.

In a tiled roof, as shown in FIG. 4, the sealing strips 9 are completely covered by covering caps 7 which are laid in an overlapping manner, so that only that portion of the flexible edge strips 13 of the sealing strips 9 located between the longitudinal edges of the covering caps 7 and the roofing tiles 3 lying below them is visible.

In FIG. 5 a sealing strip 9′ is provided with a supporting strip 10′ which, as in the case of the sealing strip 9 of FIG. 1, has a middle part 10*a*′ that rests on the ridge or hip board 6. The lateral part 10*b*′ are, however, provided with ventilation apertures 15. Each ventilation aperture is encircled by an upright edge 16, in order to prevent the ingress of rainwater which may possibly penetrate into the non-sealed joints between the overlapping ends of the covering caps 7. The lateral parts 10*b*′ of the supporting strip 10′ are pressed down by the covering caps 7 engaging supports 17 formed on supporting strip 10′ and adapted to project above the upper edge 16 of the ventilation apertures 15 whereby airflow ventilation of the roof space, as indicated by the arrows, is possible.

As can be seen in FIG. 6, a sealing strip 9′, carries ventilation apertures 15, on the lateral parts 10*b*′ of the supporting strip 10′. Apertures 15 extend in a longitudinal direction of the roof and are from each other, with upright supports 17 located in the space between two adjacent ventilation apertures 15 whereby the lateral parts 10*b*′ are pressed down over their entire length by the covering caps 7 to provide continuous ventilation of the roof space possible. At the same time, as in the case of the embodiment of FIGS. 1 to 4, the ingress of rain and driving snow is prevented by the flexible edge strips 13 connected to the comblike edge parts 12 engaging the roof tiles.

I claim:

1. A covering strip for the edge of a tiled roof having a ridge board, a plurality of covering caps fastened to said ridge board and forming an uppermost covering of said ridge board, said covering strip being located between said caps and said ridge board and comprising:

a flexible, substantially continuous support portion extending longitudinally of the strip, said strip including a pair of lateral edge portions at least one of said edge portions being subdivided into a multiplicity of transversely extending comblike teeth projecting away from said support portion of the strip, and a longitudinally extending edge strip of flexible material secured to said one edge portion and connecting said comblike teeth together, said edge strip is movable with said teeth whereby engagement of said at least one edge portion of the strip with a contoured surface of a tiled roof forms a seal with said contoured surface.

2. A covering strip as claimed in claim 1 wherein said comblike teeth of said one edge portion are each of similar shape and are uniformly spaced relative to each other.

3. A covering strip as claimed in claim 2 wherein said edge portion of the strip has a pre-formed wavelike profile fastened at its wave crests to said teeth of said tooth comblike edge part.

4. A covering strip as claimed in claim 2 wherein said edge portion of the strip is bonded to said teeth of said toothed comblike edge portion.

5. A covering strip as claimed in claim 2 wherein said edge portion of the strip and said one edge portion each have a lateral width, both of said widths being equal.

6. A covering strip as claimed in claim 2 wherein said edge strip is capable of being stretched to a length which is twice that of said subdivided one edge portion.

7. A covering strip as claimed in claim 2 wherein said support portion and its lateral edge portions are formed from rigid PVC and said edge strip is formed from plasticized PVC.

8. A covering strip as claimed in claim 6 wherein said support portion and its lateral edge portions are formed from rigid PVC and said edge strip is formed of an air-permeable bonded fabric that includes polyester or polyamide fibers.

9. A covering strip as claimed in claim 1 wherein said support portion includes a middle portion overlying said ridge board and a lateral portion spaced adjacent to said middle portion, a plurality of ventilation apertures located in said lateral portion at longitudinally spaced intervals along said support portion, and a plurality of upright supports formed in said lateral portion at spaced alternate intervals to said ventilation apertures along said supporting portion, for supporting said covering caps above said apertures.

10. A covering strip as claimed in claim 9 wherein said support portion and said lateral edge portions have a material thickness of between 0.6 to 1.5 mm, in particular 1.00 mm, and said edge strip has a material thickness of between 0.005 to 0.5 mm, in particular 0.15 mm.

11. A covering strip as claimed in claim 9 wherein the lateral width of the comblike edge portion is 50 to 100 mm, in particular 75 mm.

12. A covering strip as claimed in claim 9 wherein the width of each comblike tooth and the distance between adjacent teeth is in each case 3 to 5 mm, in particular 4 mm.

13. A covering strip as claimed in claim 1 wherein said support portion includes a middle portion overlying said ridge board and a lateral portion spaced adjacent to each side of said middle portion and carrying said toothed lateral edge portion and said edge strip, with each lateral portion biased to extend outward and upwardly, said covering cap placed over said support portion to engage and direct said comblike edge portions and said edge strip in a downward direction whereby said outer longitudinal edge of the covering strip contacts a contoured surface of the tile roof to form a seal.

14. A seal for tiled roof comprising:

a longitudinally extending strip having a rigid central substantially continuous portion extending along the strip, a flexible toothed comblike edge portion located along one lateral edge portion of said strip and having transversly extending spaced apart members projecting transversely from said central portion and lying in a common plane, an edge strip of continuous flexible material extending longitudinally of the strip and attached to said edge portion to interconnect said teeth, the length of said edge strip between adjacent teeth being greater than the distance between said adjacent teeth, whereby individual teethlike members can be displaced out of the common plane and said edge strip will conform to said displacement.

* * * * *